US008792806B2

(12) United States Patent
Morita et al.

(10) Patent No.: US 8,792,806 B2
(45) Date of Patent: Jul. 29, 2014

(54) IMAGE FORMING APPARATUS WITH MECHANISM FOR RESTRICTING REMOVAL OF DEVELOPING DEVICE

(71) Applicant: KYOCERA Document Solutions Inc., Osaka (JP)

(72) Inventors: Takashi Morita, Osaka (JP); Teruhiko Nagashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 142 days.

(21) Appl. No.: 13/677,455

(22) Filed: Nov. 15, 2012

(65) Prior Publication Data

US 2013/0136497 A1 May 30, 2013

(30) Foreign Application Priority Data

Nov. 25, 2011 (JP) ..... 2011-258130

(51) Int. Cl.

| | |
|---|---|
| ***G03G 15/04*** | (2006.01) |
| ***G03G 15/08*** | (2006.01) |
| ***G03G 21/16*** | (2006.01) |
| ***G03G 15/06*** | (2006.01) |

(52) U.S. Cl.

CPC ..... *G03G 15/06* (2013.01); *G03G 21/1676* (2013.01); *G03G 15/0877* (2013.01); *G03G 15/0896* (2013.01); *G03G 21/1647* (2013.01)

USPC ..... 399/119; 399/120

(58) Field of Classification Search

CPC ..... G03G 15/0834; G03G 21/1676; G03G 2221/1654

USPC ..... 399/119, 120

See application file for complete search history.

(56) References Cited

U.S. PATENT DOCUMENTS

| | | | | |
|---|---|---|---|---|
| 4,849,791 | A | 7/1989 | Hagihara et al. | |
| 5,079,589 | A | 1/1992 | Shibata et al. | |
| 5,121,165 | A | 6/1992 | Yoshida et al. | |
| 2005/0196195 | A1 | 9/2005 | Kim et al. | |
| 2007/0065175 | A1 | 3/2007 | Okoshi et al. | |
| 2009/0060570 | A1* | 3/2009 | Mizuno et al. | 399/114 |
| 2009/0086243 | A1 | 4/2009 | Yamazaki | |
| 2009/0123177 | A1 | 5/2009 | Dawson et al. | |
| 2012/0263495 | A1* | 10/2012 | Shimizu et al. | 399/119 |
| 2012/0263496 | A1* | 10/2012 | Morita | 399/119 |

FOREIGN PATENT DOCUMENTS

| | | |
|---|---|---|
| JP | 6-194886 | 7/1994 |
| JP | 8-220859 | 8/1996 |

* cited by examiner

*Primary Examiner* — Walter L Lindsay, Jr.
*Assistant Examiner* — Rodney Bonnette
(74) *Attorney, Agent, or Firm* — Gerald E. Hespos; Michael J. Porco; Matthew T. Hespos

(57) ABSTRACT

An image forming apparatus includes a main body housing, an image carrier, a developing device, a developer container, and an interference mechanism. The image carrier is stored in the main body housing and has a circumferential surface on which an electrostatic latent image is formed. The developing device is stored detachably in the main body housing and supplies a developer to the electrostatic latent image to develop the electrostatic latent image. The developer container is stored detachably in the main body housing and supplies the developer to the developing device. The interference mechanism disables the developing device from being removed from the main body housing, in a state in which the developer container is mounted to the main body housing.

6 Claims, 20 Drawing Sheets

IMAGE FORMING APPARATUS WITH MECHANISM FOR RESTRICTING REMOVAL OF DEVELOPING DEVICE

This application is based on Japanese Patent Application Serial No. 2011-258130 filed in Japan Patent Office on Nov. 25, 2011, the contents of which are hereby incorporated by reference.

BACKGROUND

The present disclosure relates to an image forming apparatus that has a mechanism for appropriately attaching and detaching a developing device and a developer container to and from a main body housing, the developer container supplying a developer to the developing device.

An image forming apparatus such as a printer or a copier has a developing device for supplying a developer (toner) to an electrostatic latent image formed on a photosensitive drum, and a developer container (toner container) for replenishing the developer to the developing device. A user is allowed to mount the developing device and the developer container detachably to a main body housing of the image forming apparatus. For example, when there is only a small amount of developer remaining in the developer container, the container, which is already mounted in the image forming apparatus, is removed from the main body housing in order to be replaced with a new developer container. The developing device as well is sometimes removed from the main body housing in order to be replaced with a new one.

In a small image forming apparatus in which, for example, various machines need to be disposed densely, an in-machine layout for allowing a developing device and a developer container to be removed individually from a main body housing of the image forming apparatus is adopted. Examples of the in-machine layout include a layout in which the developing device is removed from a front surface of the housing and the developer container from a rear surface.

In the image forming apparatus adopting this layout, it is expected that the developing device is removed from the main body housing, although the developer container is mounted to the main body housing. In this case, the developer scatters from a replenishing port of the developer container, resulting in a contamination of the main body housing or an area surrounding the image forming apparatus.

An object of the present disclosure is to provide an image forming apparatus in which a developing device and a developer container can appropriately be removed from a main body housing.

SUMMARY

An image forming apparatus according to one aspect of the present disclosure includes a main body housing, an image carrier, a developing device, a developer container, and an interference mechanism. The image carrier is stored in the main body housing and has a circumferential surface on which an electrostatic latent image is formed. The developing device is stored detachably in the main body housing and supplies a developer to the electrostatic latent image to develop the electrostatic latent image. The developer container is stored detachably in the main body housing and supplies the developer to the developing device. The interference mechanism disables the developing device from being removed from the main body housing, in a state in which the developer container is mounted to the main body housing.

DETAILED DESCRIPTION

Figure 1:
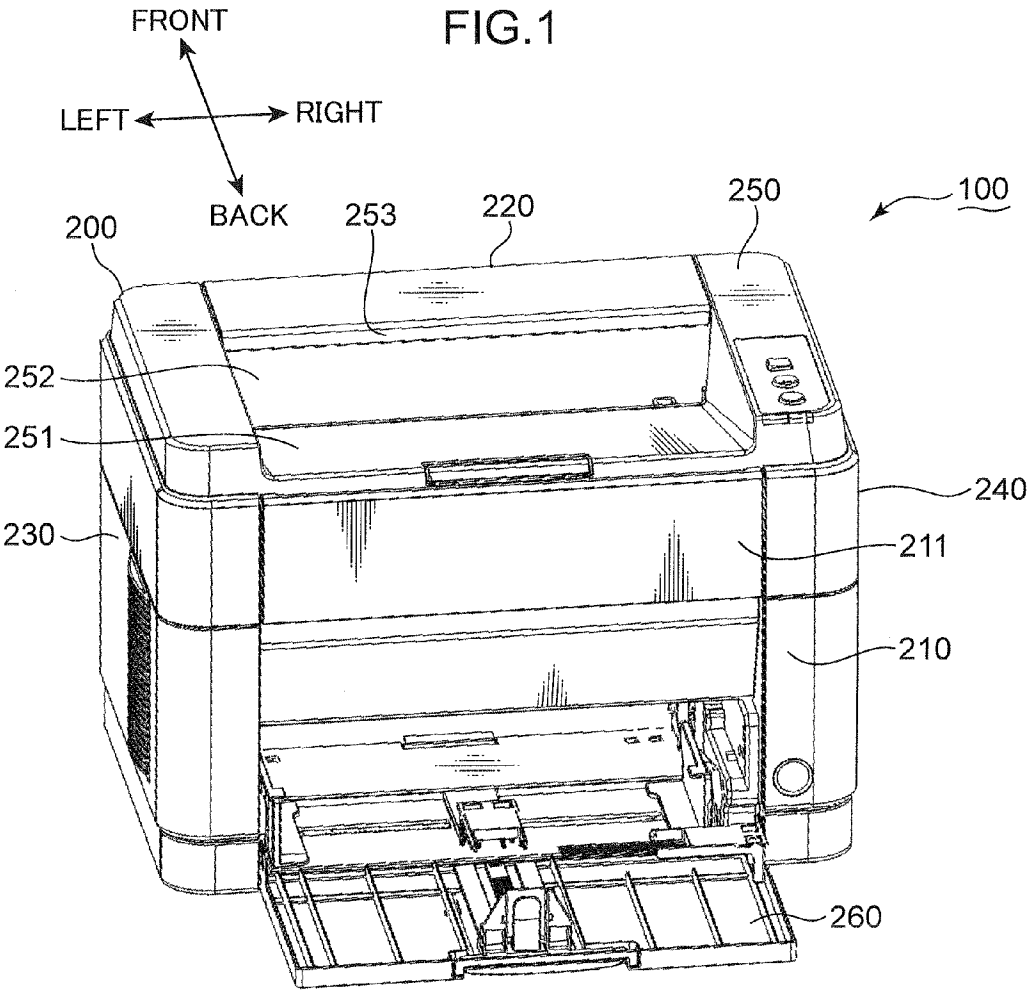
FIG. 1 is a perspective view showing the exterior of an image forming apparatus according to an embodiment of the present disclosure.
Figure 2:
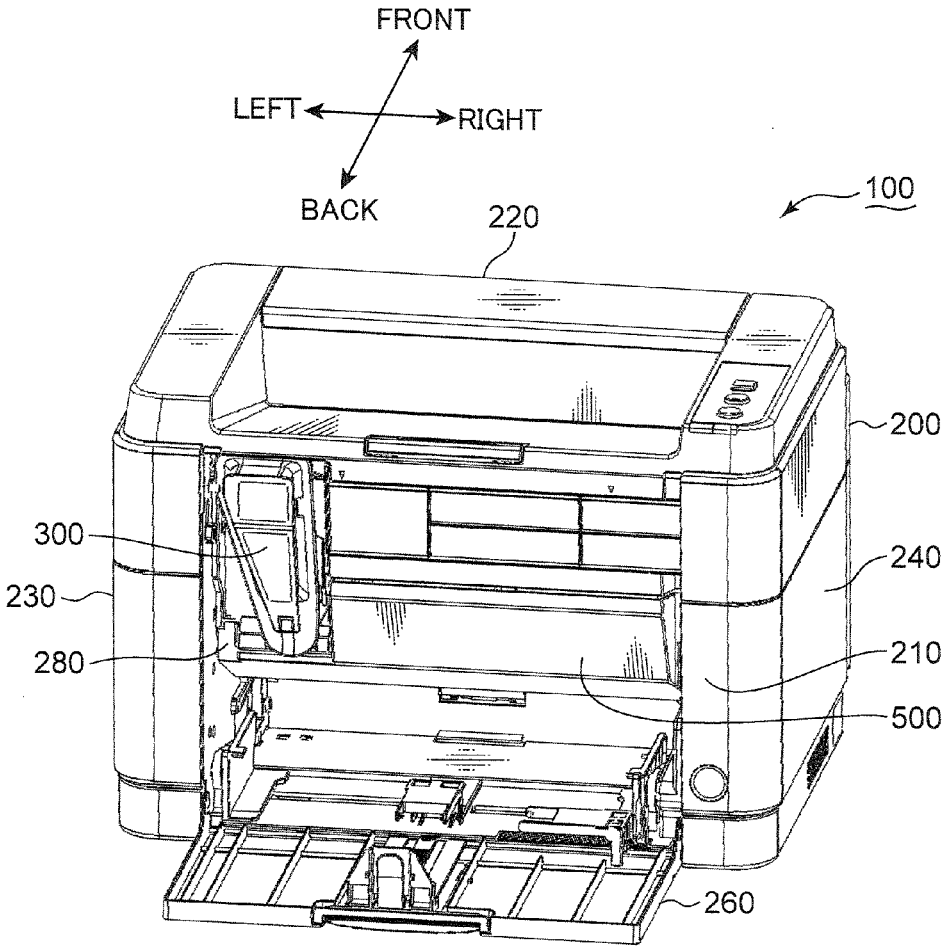
FIG. 2 is a perspective view showing the exterior of the image forming apparatus having a rear cover removed.
Figure 3:
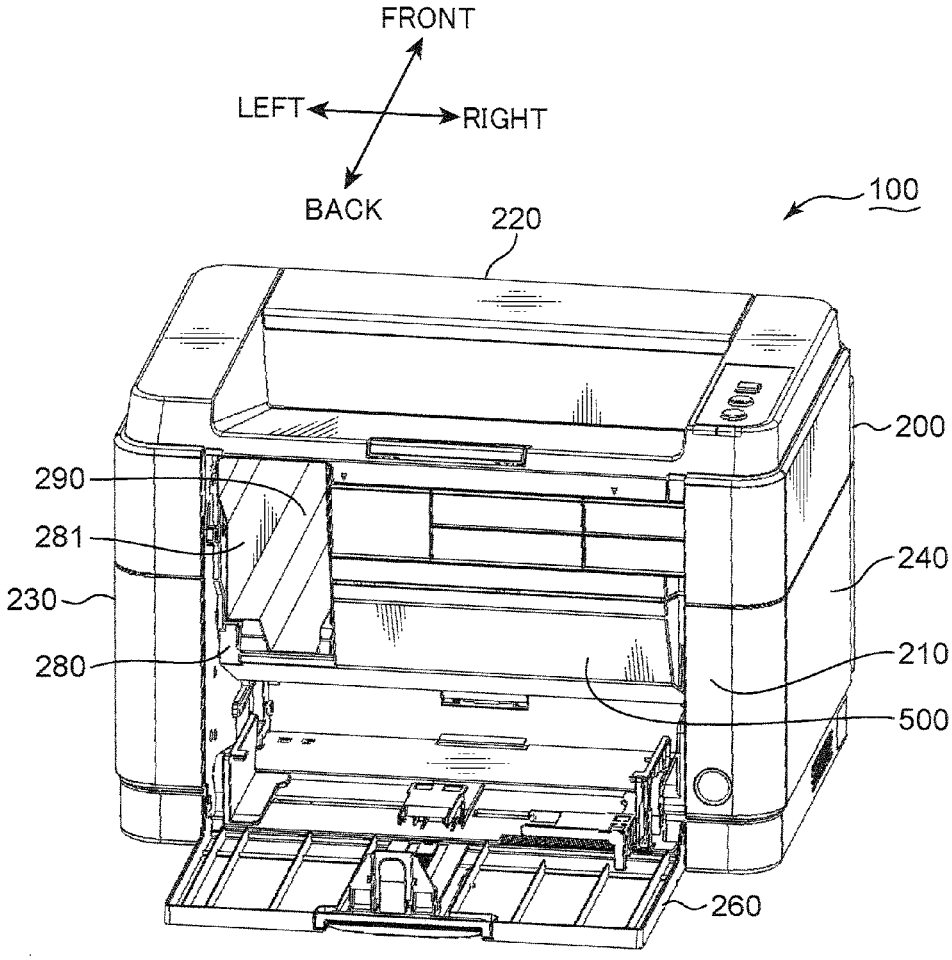
FIG. 3 is a perspective view showing the exterior of the image forming apparatus having the rear cover and a toner container removed.

Embodiments of the present disclosure are described hereinafter in detail with reference to the drawings. FIG. 1 is a perspective view showing the exterior of an image forming apparatus 100 according to an embodiment of the present disclosure. FIG. 2 is a perspective view showing a state in which a rear cover 211 is removed from a main body housing 200. FIG. 3 is a perspective view showing a state in which a toner container 300 is removed. A black and white printer is illustrated as the image forming apparatus 100. The image forming apparatus may be a copier, a facsimile device, a compound machine having these functions, or an image forming apparatus for forming color images.

The image forming apparatus 100 has the main body housing 200 that defines a storage space for storing various devices (e.g., photosensitive drums, a developing device, a toner container, etc.) functioning to form an image on a sheet. The main body housing 200 has a substantially cuboid chassis structure and includes a rear wall 210 (second surface), a front wall 220 (first surface) facing the rear wall 210, a left-side wall 230 and right-side wall 240 provided between the rear wall 210 and the front wall 220, a bottom wall used for setting the main body housing 200 thereon, and a top wall 250 configuring an upper surface of the main body housing 200.

The image forming apparatus 100 has a sheet feeding part 260 for storing sheets. The sheets stored in the sheet feeding part 260 are each fed to the main body housing 200 and subjected to an image forming process.

The top wall 250 of the main body housing 200 includes an inclined wall 251 that defines a concave part where sheets are stacked after being subjected to the image forming process, and a discharge wall 252 that stands upright from the inclined wall 251. A discharge port 253 for discharging the sheets is formed in the discharge wall 252. The sheets are discharged from the discharge port 253 and stacked on the inclined wall 251 functioning as a catch tray.

A rear cover 211 that can be opened with respect to the main body housing 200 is attached to the vicinity of an upper part of the rear wall 210. A user can remove the rear cover 211 to access various machines provided in the main body housing 200.

As shown in FIGS. 2 and 3, the image forming apparatus 100 further has a toner container 300 (developer container) for supplying toner (developer) to the a developing device 400, which is described hereinafter, a toner collection container 500 (collection container) for collecting, from an image forming part, waste toner (waste developer) that is no longer used in image formation, and an internal frame 280 that supports these containers 300, 500 and other devices for forming an image.

By opening the rear cover 211 with respect to the main body housing 200, the toner container 300 is exposed. When the toner of the toner container 300 is consumed, the user can remove the toner container 300 from the main body housing 200 and mount a new toner container 300. In other words, the toner container 300 is attached to and detached from the main body housing 200 through the rear wall 210. As shown in FIG. 3, the internal frame 280 is provided with an insertion port 281 through which the toner container 300 is inserted into the main body housing 200, and a storage space 290 of the toner container 300 is formed deep within the insertion port 281. While the toner container 300 is mounted to the main body housing 200, the toner collection container 500 cannot be removed. While the toner container 300 is removed, the toner collection container 500 can be attached to and detached from the main body housing 200 through the rear wall 210.

Figure 4:
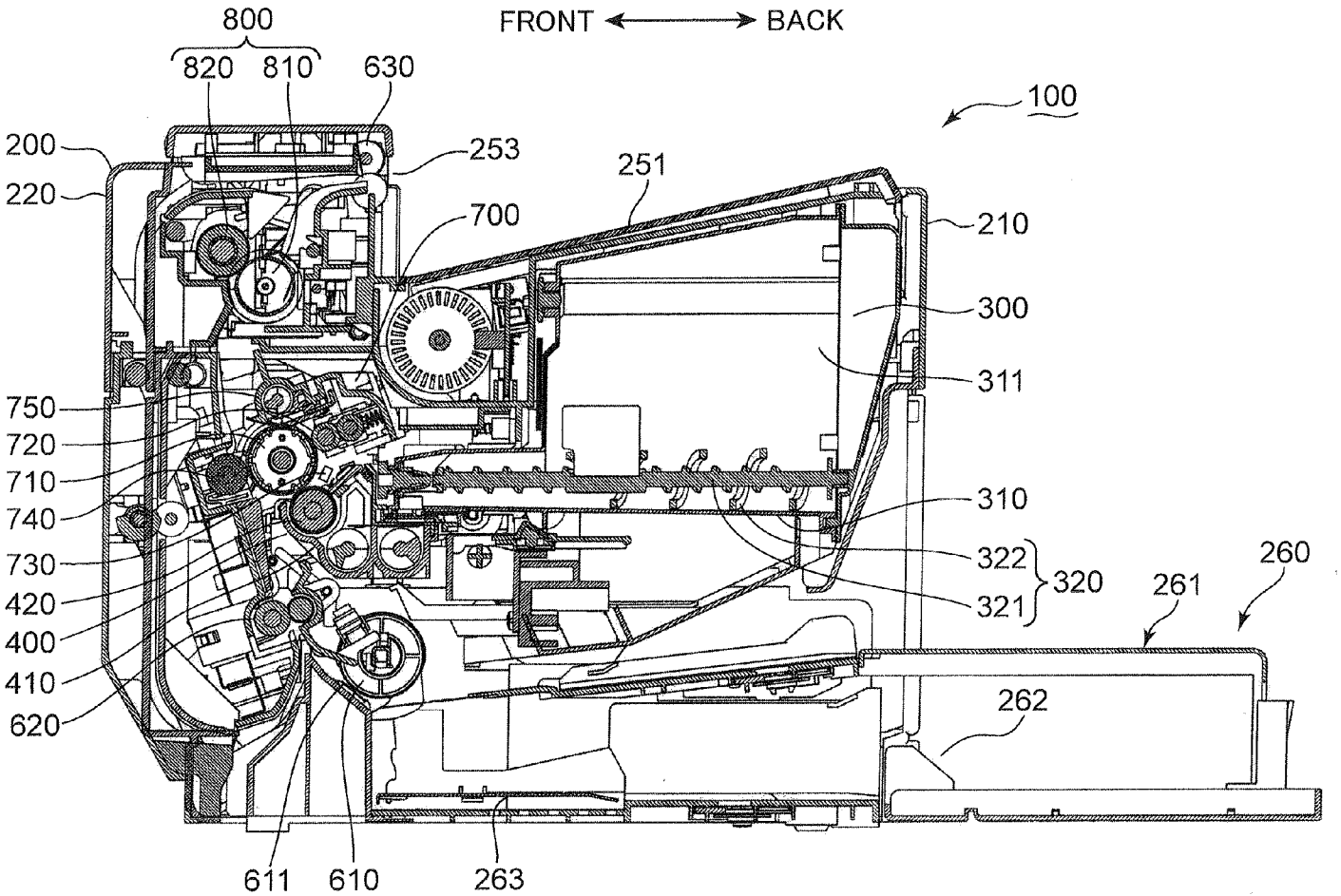
FIG. 4 is a cross-sectional diagram showing an internal structure of the image forming apparatus.

An internal structure of the image forming apparatus 100 is described next. FIG. 4 is a cross-sectional diagram showing the internal structure of the image forming apparatus 100. In addition to the toner container 300 and the toner collection container 500 described above, the image forming apparatus 100 includes the sheet feeding part 260, an image forming part 700, and a fixing part 800, which are stored in the main body housing 200.

The sheet feeding part 260 includes a sheet feeding cassette 261 in which the sheets subjected to the image forming process are stored. This sheet feeding cassette 261 partially protrudes rearward from the rear wall 210 of the main body housing 200. The sheet feeding cassette 261 is provided with a sheet storage space 262 for storing a pile of sheets, a lift plate 263 for lifting the pile of sheets for the purpose of supplying the sheets, and the like. An upper part on the front-end side of the sheet feeding cassette 261 configures a sheet delivery part. This delivery part is provided with a sheet feeding roller 610 for delivering the uppermost sheet on the pile of sheets of the sheet feeding cassette 261 one by one, and a friction plate 611 disposed below the sheet feeding roller 610. The front edge of each sheet pushed up by the lift plate 263 comes into contact with the sheet feeding roller 610, and consequently the sheet is fed out by the rotation of the sheet feeding roller 610.

The image forming part 700 performs the image forming process for forming a toner image on each of the sheets fed out from the sheet feeding part 260. The image forming part 700 includes a photosensitive drum 710 (image carrier), and a charging device 720, an exposure device 730, the developing device 400, a transfer roller 740, and a cleaning device 750, which are disposed around the photosensitive drum 710.

The photosensitive drum 710 rotates around its axis and has a circumferential surface on which an electrostatic latent image and toner image are formed. A photosensitive drum that uses an amorphous silicone (a-Si)-based material can be used as the photosensitive drum 710. The charging device 720 for charging the surface of the photosensitive drum 710 evenly includes a charging roller that comes into abutment with the photosensitive drum 710. The exposure device 730 has a laser light source and an optical instrument such as a mirror or lens, and radiates light to the circumferential surface of the photosensitive drum 710 to form an electrostatic latent image, the light being modified based on image data obtained from an external device such as a personal computer. Note that the exposure device 730 is actually not shown in the cross-sectional diagram of FIG. 1; thus, a reference numeral 730 is written in the section corresponding to the exposure position.

The developing device 400 supplies the toner to the circumferential surface of the photosensitive drum 710 in order to develop the electrostatic latent image formed on the photosensitive drum 710 to form a toner image. The developing device 400 includes a developing housing 410, a developing roller 420 that is disposed in an opening part of the developing housing 410 and carries the toner supplied to the photosensitive drum 710, and first and second conveying screws 441 and 442 (see FIG. 6) for circulating and conveying the developer while stirring the developer in the developing housing 410. The developing device 400 is described hereinafter in detail.

The transfer roller 740 is a roller for transferring the toner image formed on the circumferential surface of the photosensitive drum 710, to a sheet, and forms a transfer nip part together with the photosensitive drum 710. A transfer bias having a polarity opposite to that of the toner is applied to this transfer roller 740. The cleaning device 750 has a cleaning roller and the like and cleans the circumferential surface of the photosensitive drum 710 after the transfer of the toner image.

The fixing part 800 performs a fixing process for fixing the transferred toner image onto the sheet. The fixing part 800 includes a fixing roller 810 having a heat source therein, and a pressure roller 820 that is brought into pressure contact with the fixing roller 810 to form a fixing nip part together with the fixing roller 810. When the sheet with the toner image thereon passes through the fixing nip part, the toner image is fixed to the sheet as a result of the heat of the fixing roller 810 and the pressure of the pressure roller 820.

The toner container 300 stores the toner (developer) to be replenished to the developing device 400. The toner container 300 includes a container main body 310 defining a toner accumulation space 311, and a rotating member 320 that is arranged in the container main body 310 and conveys the toner. The rotating member 320 has a rotating shaft 321 and a conveying member 322 that is rotated integrally with the rotating shaft 321. The toner that is stored in the toner container 300 is supplied from a toner discharge port 319 (FIG. 7) to the developing device 400 as the rotating member 320 is driven to rotate. The toner container 300 is also described hereinafter in detail.

A sheet conveying path for conveying the sheets is provided inside the main body housing 200. The primary sheet conveying path extends from the sheet feeding roller 610 of the sheet feeding part 260 to the discharge port 253 in the upper part of the main body housing 200 via the image forming part 700 and the fixing part 800. A resist roller pair 620 is disposed in a section upstream from the transfer nip part between the photosensitive drum 710 and the transfer roller 740 in the sheet conveying path. The sheet stops once at the resist roller pair 620 and is fed out to the transfer nip part at predetermined image transfer timing after skew correction. Furthermore, a discharge roller pair 630 is disposed in the vicinity of the discharge port 253.

Figure 5:
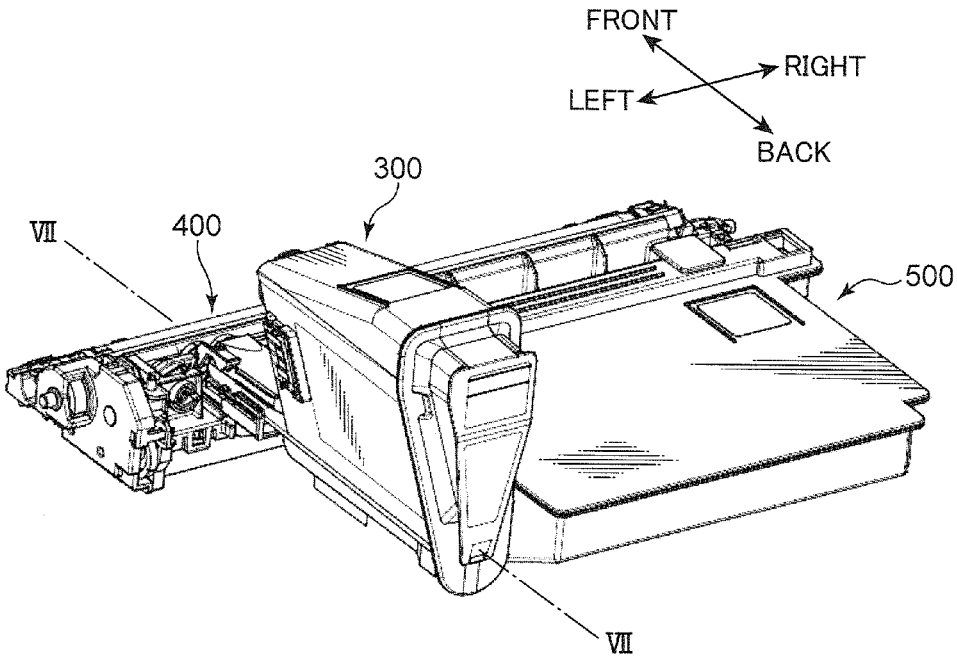
FIG. 5 is a perspective view showing a developing device, toner container, and toner collection container incorporated in the image forming apparatus.

Structures of the developing device 400, the toner container 300, and the toner collection container 500, as well as the positional relationship therebetween, are now described. FIG. 5 is a perspective view showing the developing device 400, the toner container 300, and the toner collection container 500 mounted to the main body housing 200. The developing device 400 has a shape elongating in an axial direction (lateral direction) of the developing roller 420. The toner container 300 is in the shape of a long housing as viewed from top and is installed in the vicinity of a left end of the developing device 400 from a front-back direction that is perpendicular to the axial direction within a horizontal plane. The toner collection container 500, on the other hand, is a rectangular box disposed in a space formed behind the developing device 400 and to the right of the toner container 300. Unlike the toner container 300 and the toner collection container 500, the developing device 400 can be attached to and detached from the main body housing 200 via the front wall 220.

Figure 6:
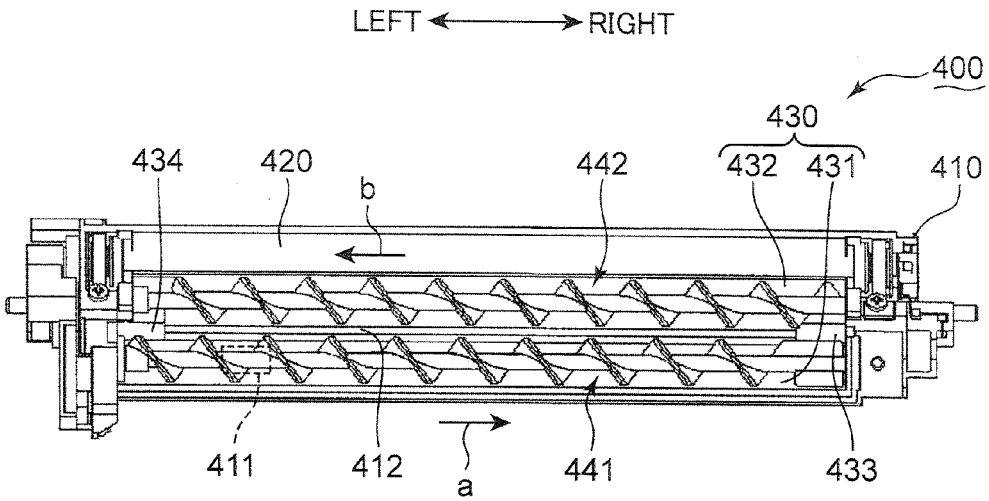
FIG. 6 is a plan view showing an internal structure of the developing device.
Figure 7:
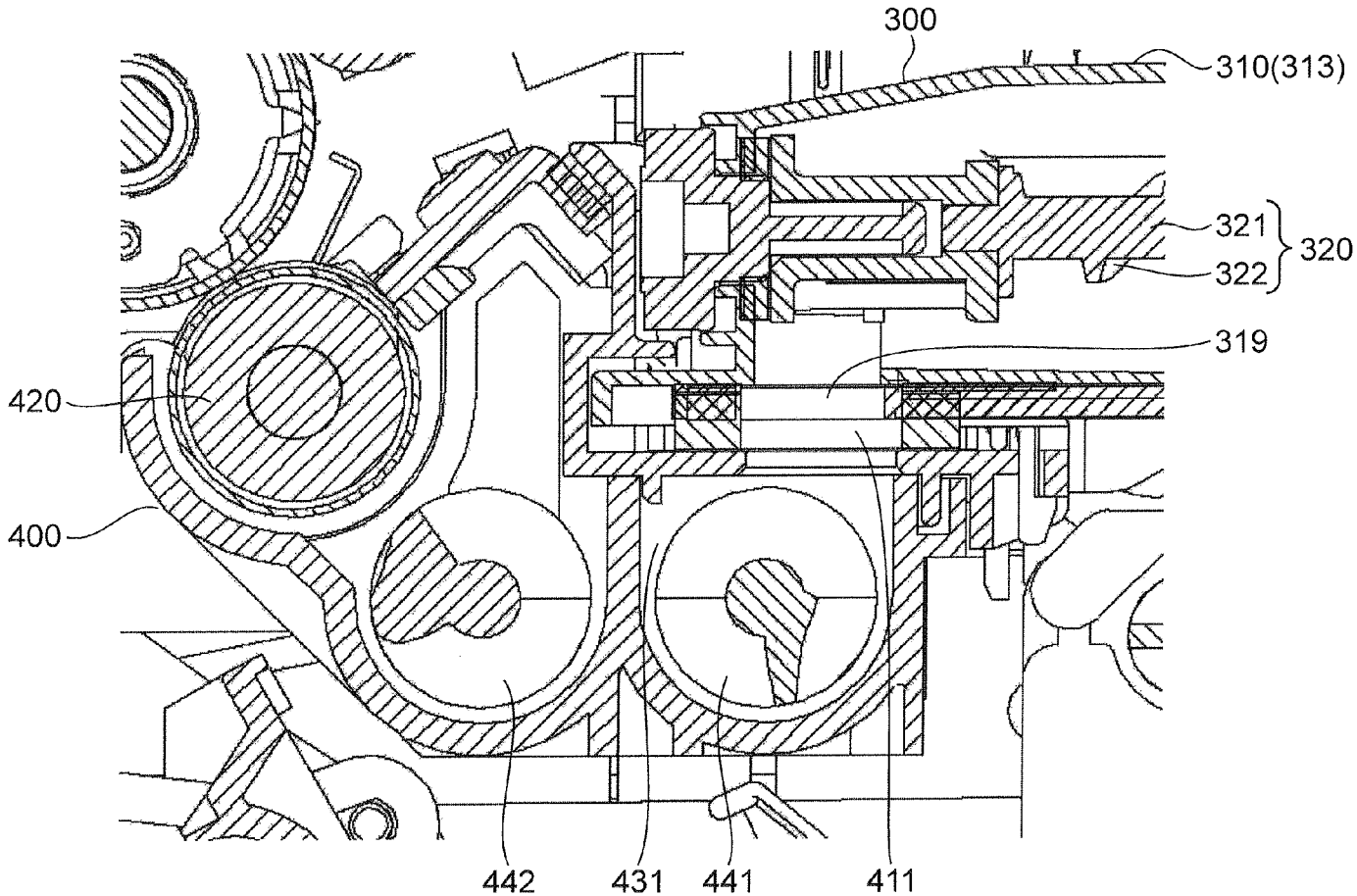
FIG. 7 is a cross-sectional diagram taken along line VII-VII of FIG. 5, showing a periphery of a coupling part between the developing device and the toner container.
Figure 8:
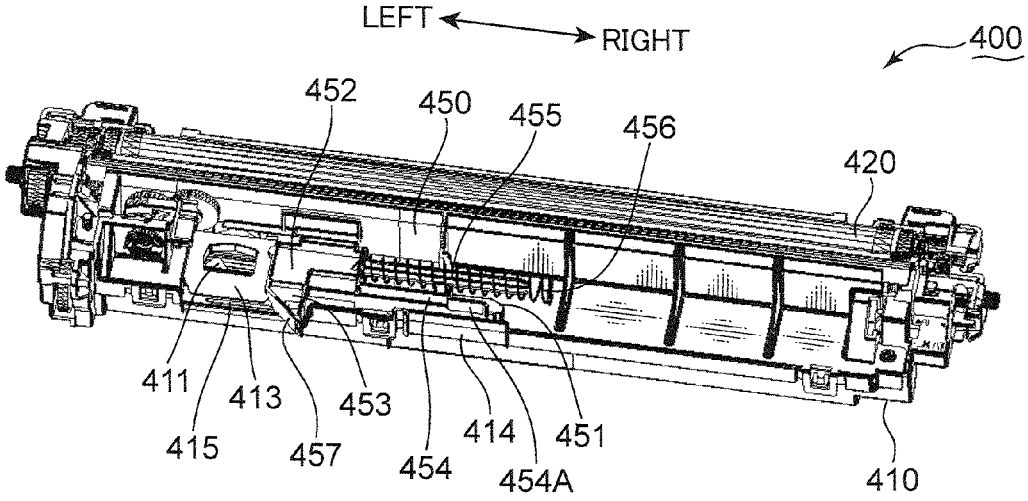
FIG. 8 is a perspective view of the developing device alone, showing a state in which a shutter member is opened.
Figure 9:
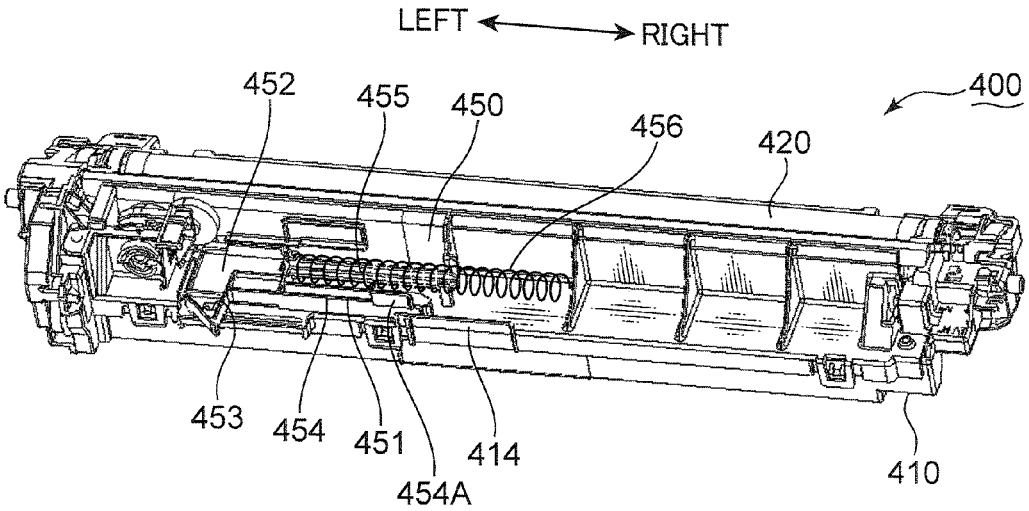
FIG. 9 is a perspective view of the developing device alone, showing a state in which the shutter member is closed.

FIG. 6 is a plan view showing an internal structure of the developing device 400. FIG. 7 is a cross-sectional diagram taken along line VII-VII of FIG. 5, showing a periphery of a coupling part between the developing device 400 and the toner container 300. FIG. 8 is a perspective view of the developing device 400 alone, showing a state in which a shutter member 451 is opened. FIG. 9 shows a state in which the shutter member 451 is closed.

The developing device 400 has the developing housing 410 that is in the shape of a box elongating in the axial direction of the developing roller 420. The developing housing 410 has an opening part extending in a longitudinal direction of the developing housing 410, and a part of a circumferential surface of the developing roller 420 is exposed from the opening part. In the present embodiment, the developing housing 410 is installed in the main body housing 200 such that the longitudinal direction of the developing housing 410 matches a lateral direction of the main body housing 200.

A replenishing port 411 is pierced in an upper surface in the vicinity of a left end of the developing housing 410 in order to receive the toner supplied from the toner container 300 into the developing housing 410 (FIG. 8). As shown in FIG. 7, the developing device 400 and the toner container 300 are installed such that the toner replenishing port 411 and the toner discharge port 319 of the toner container 300 are stacked in a vertical direction.

As shown in FIG. 6, the developing housing 410 has an internal space 430. In case of two-component development, this internal space 430 is filled with a developer consisting of toner and carrier. The carrier is stirred and mixed with the toner in the internal space 430, thereby charging the toner. The toner is then conveyed to the developing roller 420. The toner is then supplied to the developing roller 420 sequentially, and the amount of toner corresponding to the amount consumed is supplied appropriately from the toner container 300.

The internal space 430 of the developing housing 410 is divided into first and second passages 431 and 432 elongating in the lateral direction, by a partition plate 412 extending in the lateral direction. The partition plate 412 is narrower than a lateral width of the developing housing 410. Right and left ends of the partition plate 412 are provided with first and second communication parts 433 and 434, respectively, for allowing the first passage 431 and the second passage 432 to communicate with each other. Therefore, a circulation path reaching the first passage 431, the first communication part 433, the second passage 432, and the second communication part 434 is formed inside the developing housing 410.

The toner replenishing port 411 described above is disposed above the vicinity of a left end of the first passage 431. The first conveying screw 441 is stored in the first passage 431, and the second conveying screw 442 is stored in the second passage 432. The first and second conveying screws 441 and 442 each include a shaft and a blade member that projects spirally on a circumference of the shaft. The first conveying screw 441 is driven to rotate about the shaft to convey the developer in a direction of an arrow a shown in FIG. 6. The second conveying screw 442, on the other hand, is driven to rotate about the shaft to convey the developer in a direction of an arrow b.

As a result of the rotation of the first and second conveying screws 441 and 442, the developer is circulated and conveyed along the circulation path described above. In regard to new toner replenished from the toner replenishing port 411, this toner is dropped onto the first passage 431, mixed with the existing developer, and then conveyed in the direction of the arrow a by the first conveying screw 441. In so doing, the toner is stirred with the carrier and charged. The toner then enters the second passage 432 from a downstream end of the first passage 431 through the first communication part 433 and is conveyed in the direction of the arrow b by the second conveying screw 442. In this conveyance, while the toner is similarly charged, some of the toner is supplied to the circumferential surface of the developing roller 420. Subsequently, the remaining toner and the carrier are returned to an upstream end of the first passage 431 via the second communication part 434.

As shown in FIGS. 8 and 9, the upper surface of the developing housing 410 is provided with a shutter mechanism 450 for opening/closing the toner replenishing port 411. The shutter mechanism 450 includes the shutter member 451 capable of sliding in the lateral direction. The shutter member 451 can change the posture thereof between a closing posture for covering the toner replenishing port 411 (FIG. 9) and an opening posture for opening the toner replenishing port 411.

The periphery of the toner replenishing port 411 of the developing housing 410 is configured as a flat sliding surface 413. Moreover, a substantially rectangular guide plate 414 that protrudes upward with respect to the sliding surface 413 is provided in the vicinity of the center in the lateral direction of the developing housing 410.

Figure 10:
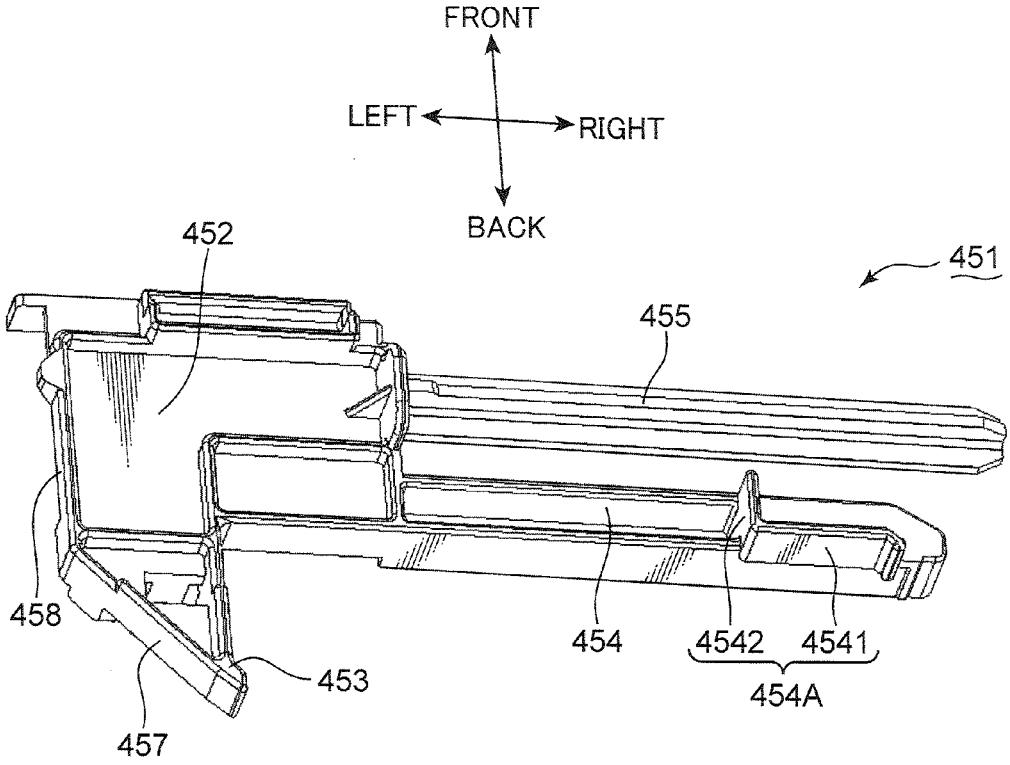
FIG. 10 is a perspective view of the shutter member.

FIG. 10 is a perspective view of the shutter member 451. The shutter member 451 includes a substantially rectangular sliding plate 452 that slides on the sliding surface 413 while the shutter member 451 slides to change between the closing posture and the opening posture, a substantially right triangular protruding plate 453 that protrudes rearward from the sliding plate 452, a guide click 454 that extends rightward from the sliding plate 452, and a shaft 455 that extends parallel to the guide click 454 to the front of the guide click 454. The sliding plate 452 is large enough to close the toner replenishing port 411 in the closing posture of the shutter member 451. When the shutter member 451 slides between the closing posture and the opening posture, the guide click 454 comes into sliding contact with the guide plate 414. Therefore, the shutter member 451 can stably be displaced when sliding.

The shutter mechanism 450 further has a coil spring 456 for biasing the shutter member 451 constantly to the left (direction of the closing posture). The coil spring 456 has one end inserted to the shaft 455 and the other end brought into abutment with a rib adjacent to the shutter member 451. When the toner container 300 is not yet mounted to the developing device 400, the shutter member 451 is biased to the left by the coil spring 456, entering its closing posture for closing the toner replenishing port 411. As described hereinafter in detail, when the toner container 300 is mounted to the developing device 400, the toner container 300 and the shutter member 451 interfere with each other, and the shutter member 451 moves to the right against the bias of the coil spring 456, entering its opening posture. Here, an inclined part 457 of the protruding plate 453 and a left edge part 458 of the sliding plate 452 actually interfere with the toner container 300 (a pressing part 314).

A first locking piece 454A (a part of an interference mechanism) is provided in a protruding manner on a right-end upper surface of the guide click 454 of the shutter member 451. The first locking piece 454A is a member that disables the developing device 400 from being removed from the main body housing 200 when the toner container 300 is mounted to the main body housing 200. The first locking piece 454A is configured by a first interference wall 4541 standing upright from a rear edge of the guide click 454 and extending in the lateral direction, and a first rib 4542 extending forward from a left edge of the first interference wall 4541. The first locking piece 454A is brought into engagement with (interferes with) a second locking piece 510 of the toner collection container 500 when the shutter member 451 is in its opening posture, and is disengaged from the second locking piece 510 when the shutter member 451 is in its closing posture. This fact is described hereinafter in detail with reference to FIGS. 19 and 20.

Figure 11:
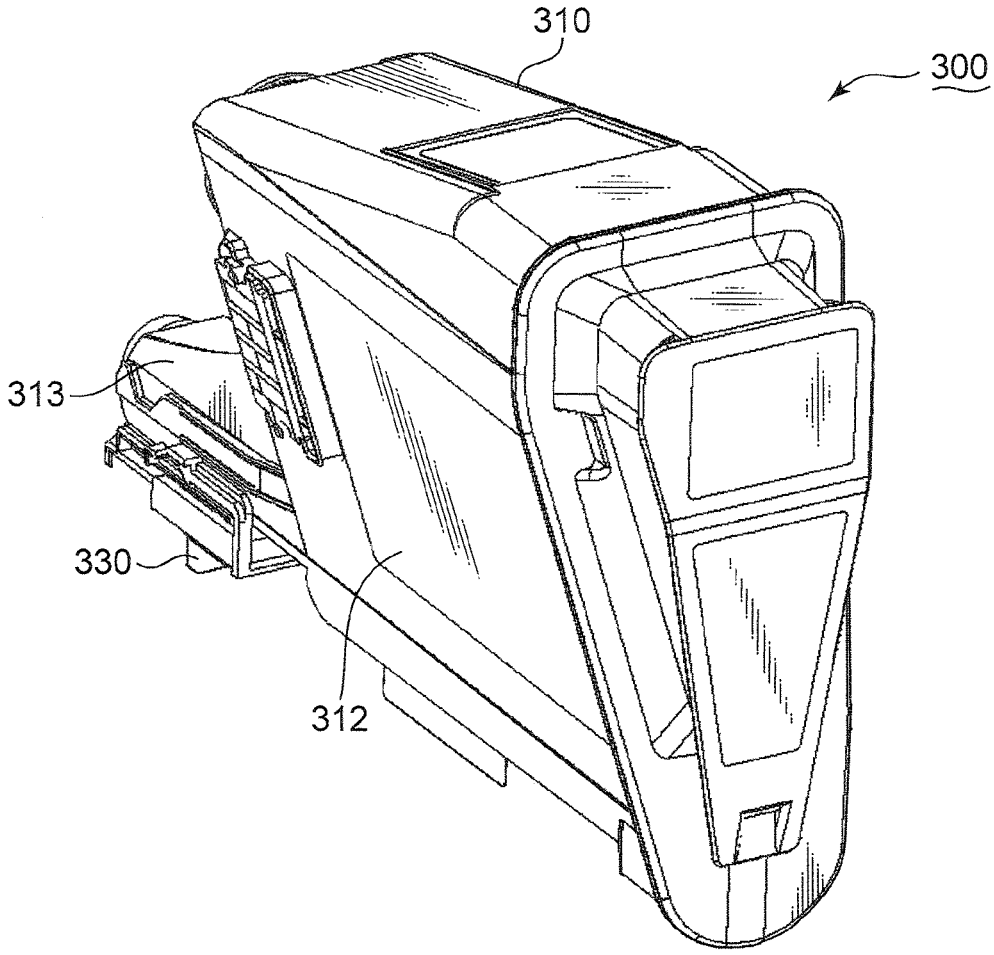
FIG. 11 is a perspective view of the toner container.
Figure 12:
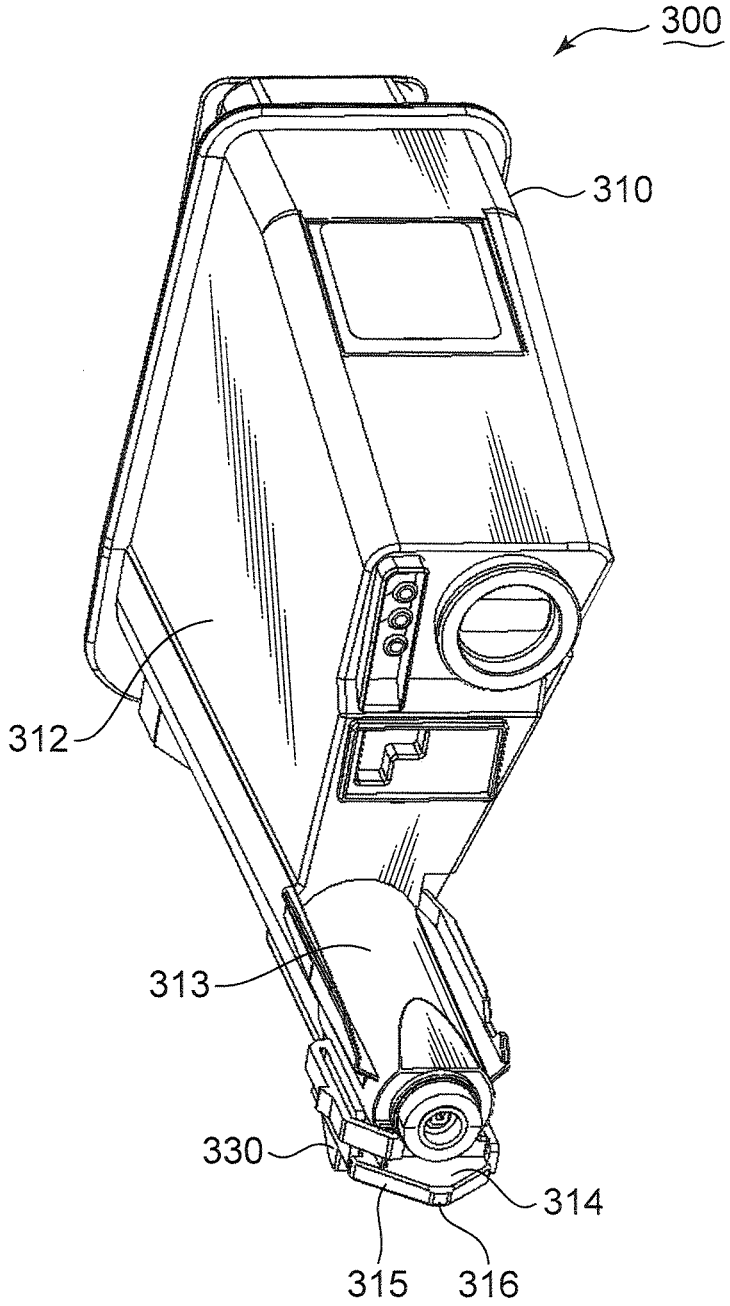
FIG. 12 is a perspective view showing the toner container of FIG. 11 reversed 180 degrees.

FIG. 11 is a perspective view of the toner container 300. FIG. 12 is a perspective view showing the toner container 300 of FIG. 11 reversed 180 degrees. The container main body 310 of the toner container 300 includes a main storage part 312 having a relatively large volume to store a large portion of the toner, and a tubular part 313 that projects from a lower part of the main storage part 312. The rotating member 320 shown in FIG. 4 and FIG. 7 is provided in the area from a bottom part of the main storage part 312 to the tubular part 313. The toner is conveyed from the main storage part 312 to the tubular part 313 as the rotating member 320 rotates.

The toner discharge port 319 (FIG. 7) described above is provided in a lower part near a projecting tip end of the tubular part 313. A container shutter 330 is installed in the lower part of the tubular part 313 in order to open/close the toner discharge port 319. The container shutter 330 is biased in a direction of the projecting tip end of the tubular part 313 by a biasing member, not shown, so as to constantly close the toner discharge port 319. However, when the toner container 300 is mounted to the developing device 400, the container shutter 330 interferes with a rear edge part 415 (see FIG. 8) provided in the vicinity of the toner replenishing port 411 of the developing housing 410, and slides so as to open the toner discharge port 319.

The pressing part 314 that is in the shape of an isosceles triangle is integrally attached to the projecting tip end of the tubular part 313. The pressing part 314 has a protruding tip end 316 that protrudes farthest out, and inclined surfaces 315 positioned on either side of the protruding tip end 316. When the toner container 300 is mounted to the main body housing 200, the pressing part 314 comes into contact with the shutter member 451 of the developing device 400 first. The pressing part 314 then changes the posture of the shutter member 451 to the opening posture, against the bias of the coil spring 456.

Figure 13:
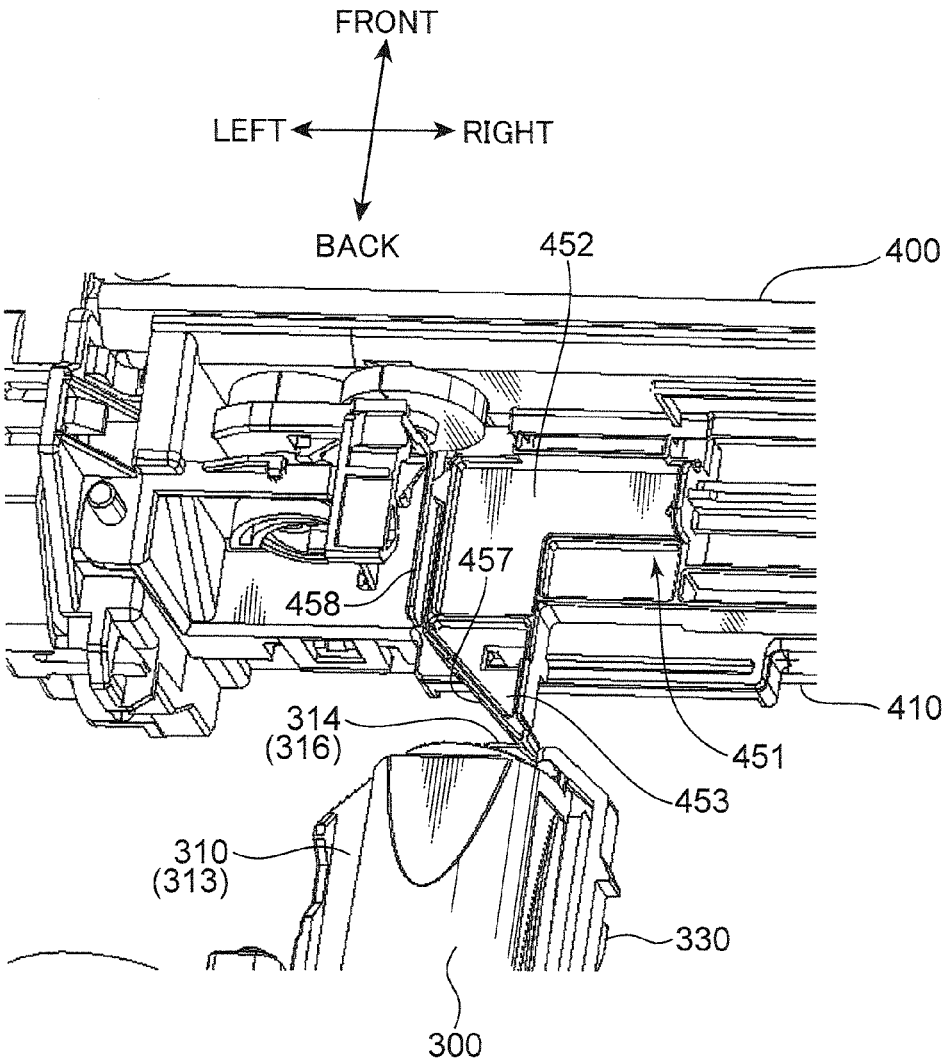
FIG. 13 is a perspective view showing a step of coupling the developing device and the toner container to each other.
Figure 14:
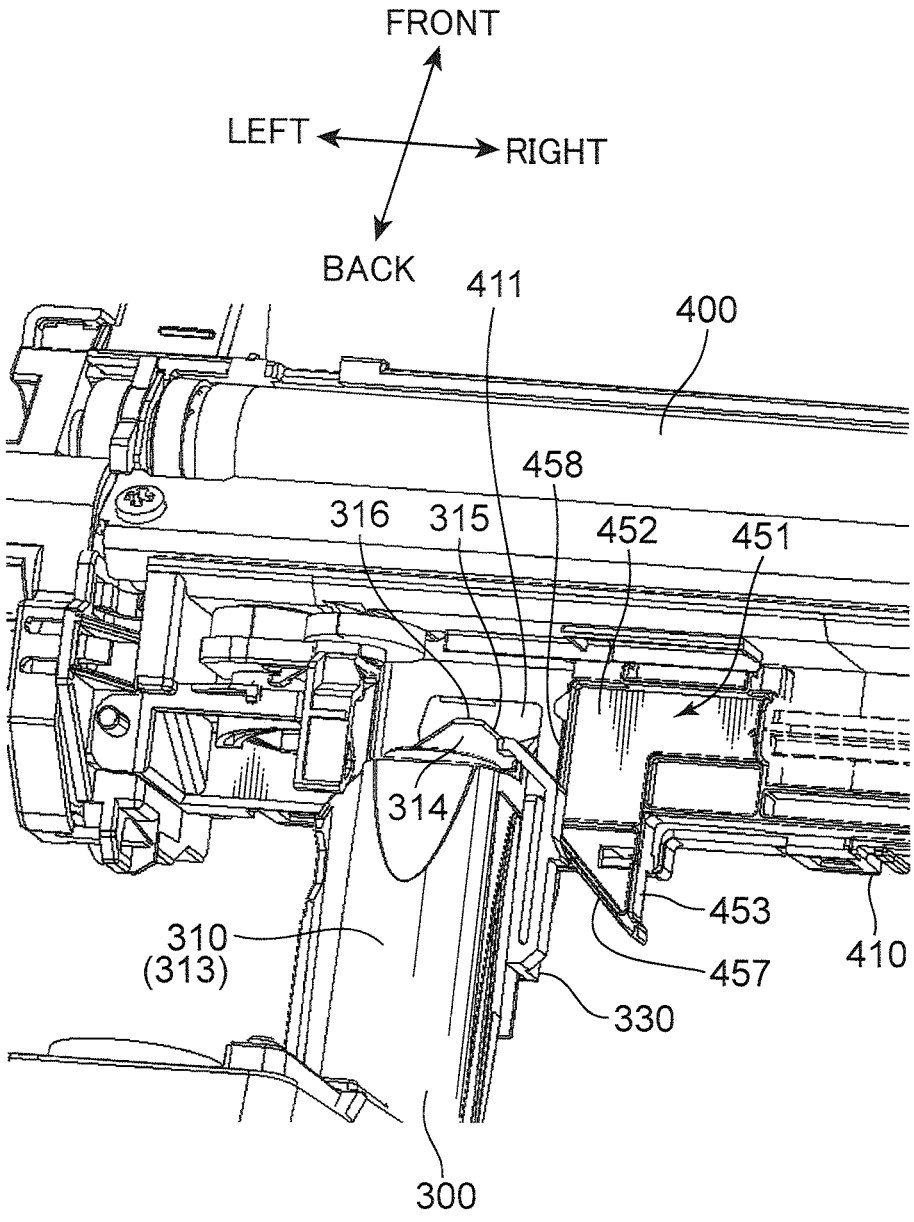
FIG. 14 is a perspective view showing the step of coupling the developing device and the toner container to each other.
Figure 15:
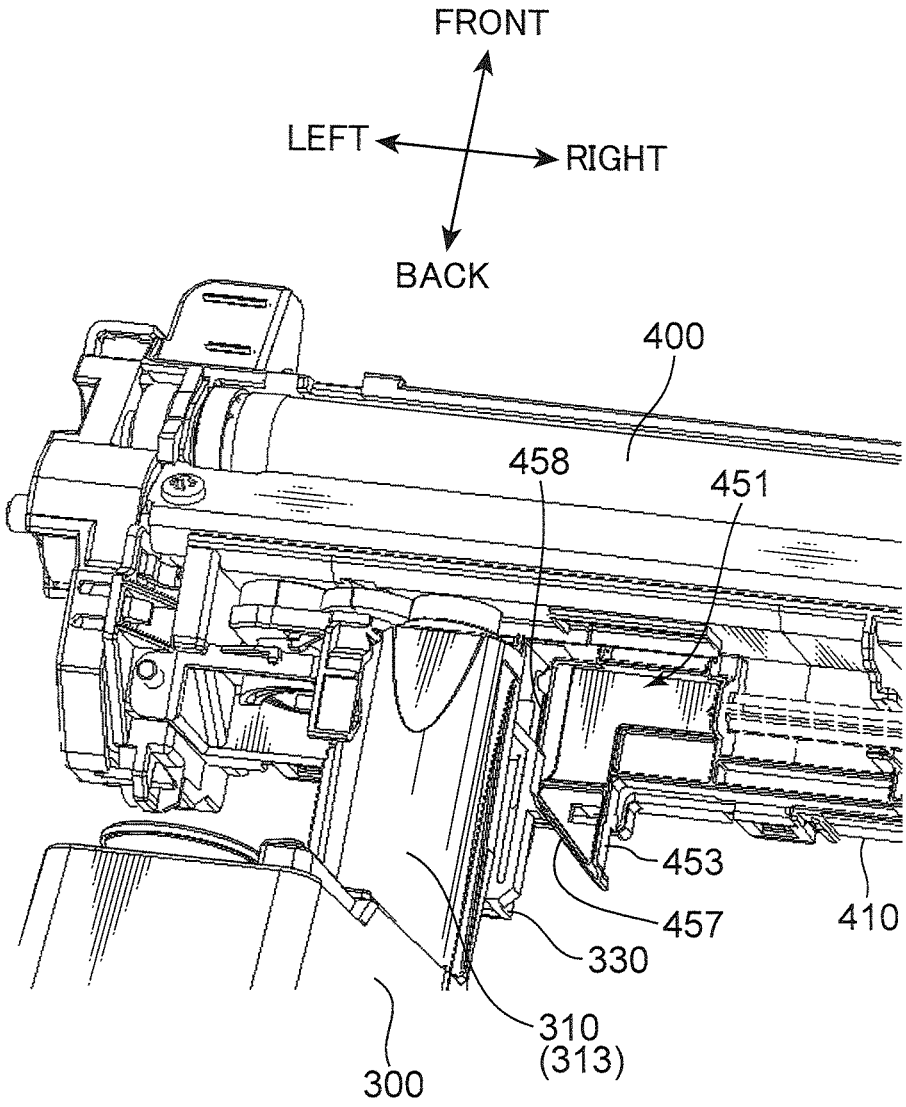
FIG. 15 is a perspective view showing the step of coupling the developing device and the toner container to each other.

Opening operations of the shutter member 451 performed by the pressing part 314 are now described with reference to FIGS. 13 to 15. FIGS. 13 to 15 are each a perspective view showing a step of coupling the developing device 400 and the toner container 300 to each other. FIG. 13 shows a state in which the toner container 300 is inserted into the storage space 290 (FIG. 3) of the main body housing 200 to some extent, the state being obtained immediately before the protruding tip end 316 of the pressing part 314 comes into contact with (interferes with) a tip end of the protruding plate 453 of the shutter member 451. Thereafter, the inclined surfaces 315 of the pressing part 314 and the inclined part 457 of the protruding plate 453 come into contact with each other as the forward insertion of the toner container 300 continues. As a result, the shutter member 451 is pressed and moved to the right by the inclined surfaces 315, gradually opening the toner replenishing port 411.

FIG. 14 shows a state in which the inclined surfaces 315 of the pressing part 314 pass through the position of the inclined part 457 of the protruding plate 453 and a right edge of the tubular part 313 starts coming into contact with (interfering with) the left edge part 458 of the sliding plate 452. At this moment, the shutter member 451 is already in its opening posture. The container shutter 330, on the other hand, starts interfering with the rear edge part 415 of the developing housing 410 in the state shown in FIG. 14. In other words, in the stage shown in FIG. 14, the container shutter 330 covers the toner discharge port 319.

FIG. 15 shows a state in which the forward insertion of the toner container 300 further continues, and, consequently, the toner container 300 reaches a predetermined mounting position. In this state, the container shutter 330, too, is opened completely by interfering with the rear edge part 415 of the developing housing 410. In other words, in the state shown in FIG. 15, corresponding to the cross-sectional diagram of FIG. 7, the toner replenishing port 411 and the toner discharge port 319 are aligned. The timing of opening the toner replenishing port 411 of the developing device 400 is earlier than the timing of opening the toner discharge port 319 of the toner container 300. For this reason, the toner contained in the toner container 300 is rarely leaked to the outside of the developing device 400.

Figure 16A:
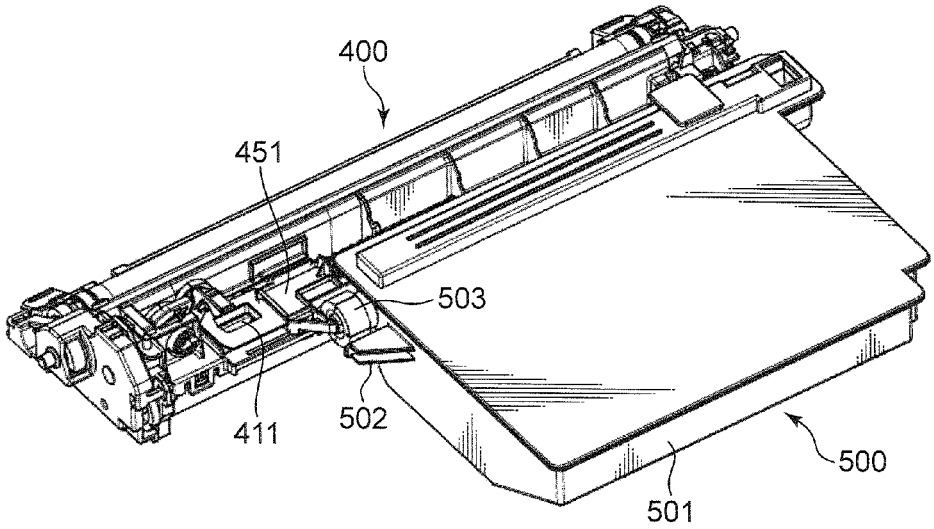
FIGS. 16A and 16B are perspective views each showing the developing device and the toner collection container that are incorporated in the image forming apparatus.
Figure 16B:
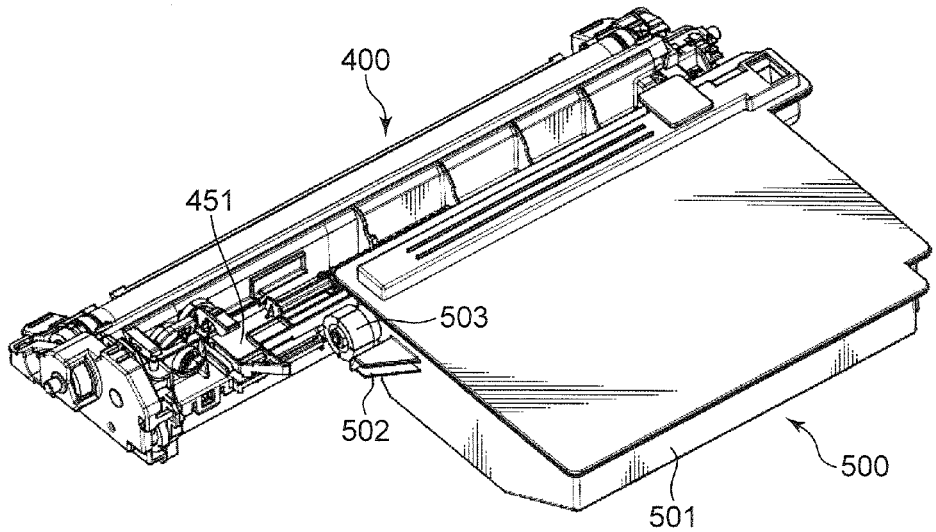
Figure 17:
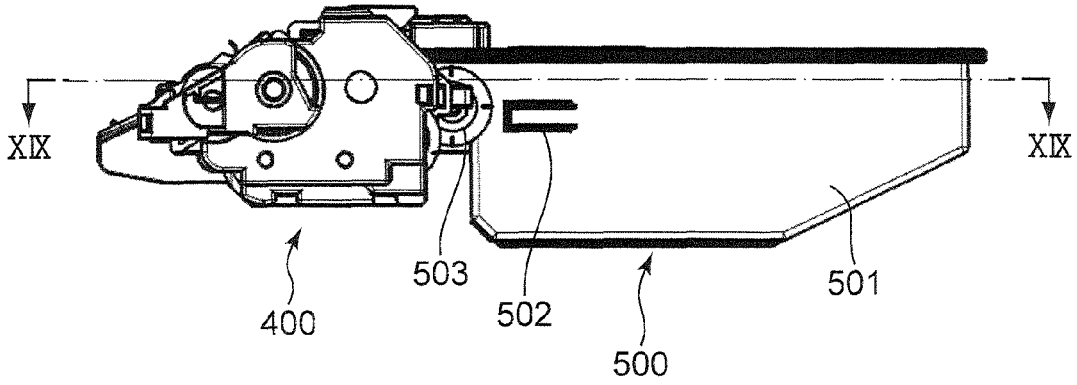
FIG. 17 is a side view of the developing device and the toner collection container shown in FIG. 16A.

FIGS. 16A and 16B are perspective views each showing the positional relationship between the developing device 400 and the toner collection container 500. FIG. 16A shows the opening posture of the shutter member 451, and FIG. 16B the closing posture of the shutter member 451. FIG. 17 is a side view of FIG. 16A. As is clear from FIGS. 16A to 17, the toner collection container 500 is disposed behind the developing device 400 so as to be adjacent thereto on substantially the same level in height as the developing device 400. Particularly, the shutter member 451 is moved along a front edge part of the toner collection container 500. With this positional relationship, the second locking piece 510 that comes into engagement with the first locking piece 454A of the shutter member 451 is provided in the toner collection container 500.

Figure 18:
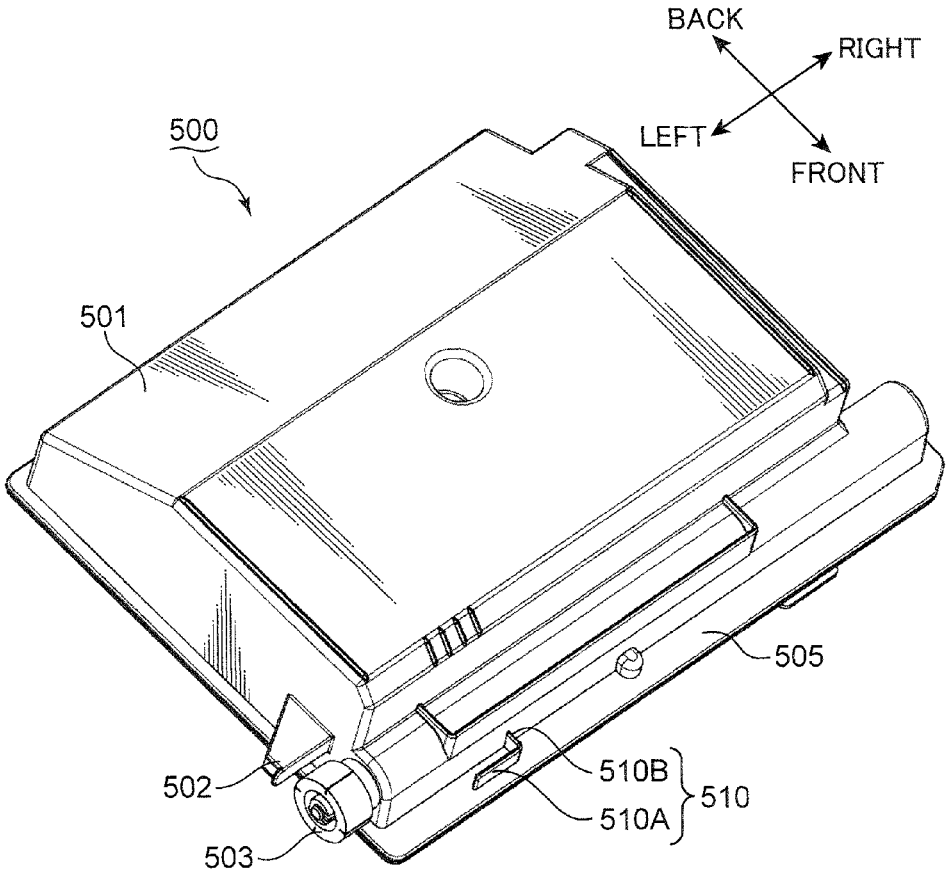
FIG. 18 is a perspective view of the toner collection container.

FIG. 18 is a perspective view showing the back of the toner collection container 500. The toner collection container 500 is a container for collecting waste toner (waste developer) that is no longer used in image formation in the image forming part 700. The waste toner is collected from the circumferential surface of the photosensitive drum 710 by the cleaning device 750 and conveyed into the toner collection container 500 through a conveying path that is not shown.

The toner collection container 500 has a container main body 501 for accumulating the waste toner, a locking projection 502 provided in a protruding manner in a left-hand side of the container main body 501, and a drive input gear 503 that applies rotary drive force to a waste toner conveying screw 504 (see FIGS. 19 and 20) stored in the container main body 501. The locking projection 502 is retained by a retaining piece of the main body housing 200, which is not shown, in a state in which the toner collection container 500 is mounted to the main body housing 200.

A relatively wide, belt-like flange part 505 is formed at a front end of the container main body 501. A lower surface of the flange part 505 is provided with the second locking piece 510 (a part of the interference mechanism) that protrudes and comes into engagement with the first locking piece 454A of the shutter member 451. The second locking piece 510 is an L-shaped projecting piece that is configured by a second interference wall 510A extending in the lateral direction and a second rib 510B extending rearward from a right edge of the second interference wall 510A.

In the image forming apparatus 100 of the present embodiment, the developing device 400 is attached to and detached from the main body housing 200 via the front wall 220, whereas the toner container 300 and the toner collection container 500 are attached to and detached from the main body housing 200 via the rear wall 210, as described above. This is because the image forming apparatus 100 is a small image forming apparatus in which various machines need to be disposed densely and there is a limit on the in-machine layout. The image forming apparatus 100 has a layout in which, instead of placing the toner container 300 directly on the developing device 400, the toner container 300 is installed in the developing device 400 such that the toner container 300 and the developing device 400 are disposed perpendicular to each other.

In regard to the order of removing the devices from a main body housing, generally, first a toner container is removed, and then a developing device is removed. Normally, because the toner container is provided with a container shutter for opening/closing a toner discharge port in synchronization with the mounting and removing operations of the toner container with respect to the developing device, removing the toner container first can prevent the toner from scattering from the toner discharge port. The reason that the toner container 300 of the present embodiment is provided with the container shutter 330 is as described above. In the layout described above, however, because the toner container 300 and the developing device 400 are attached to and detached from different surfaces, the user is unlikely to adopt the order in which the toner container 300 is removed from the main body housing 200 first and then the developing device 400 is removed from the main body housing 200. Therefore, it is expected that the developing device 400 is removed from the front wall 220 of the main body housing 200, although the toner container 300 is mounted to the main body housing 200. In this case, the toner scatters from the toner discharge port 319 of the toner container 300, resulting in a contamination of the main body housing 200 or an area surrounding the image forming apparatus 100.

In order to prevent such contamination, the first locking piece 454A and the second locking piece 510 are brought into engagement with each other in a sate in which the toner container 300 is mounted to the main body housing 200 (the developing device 400) or, in other words, when the shutter member 451 is in the opening posture, so that the developing device 400 is not removed from the main body housing 200. When the toner container 300 is removed from the main body housing 200 and the shutter member 451 is in the closing posture, the engagement between the first locking piece 454A and the second locking piece 510 is released, allowing the developing device 400 to be removed from the main body housing 200.

Figure 19:
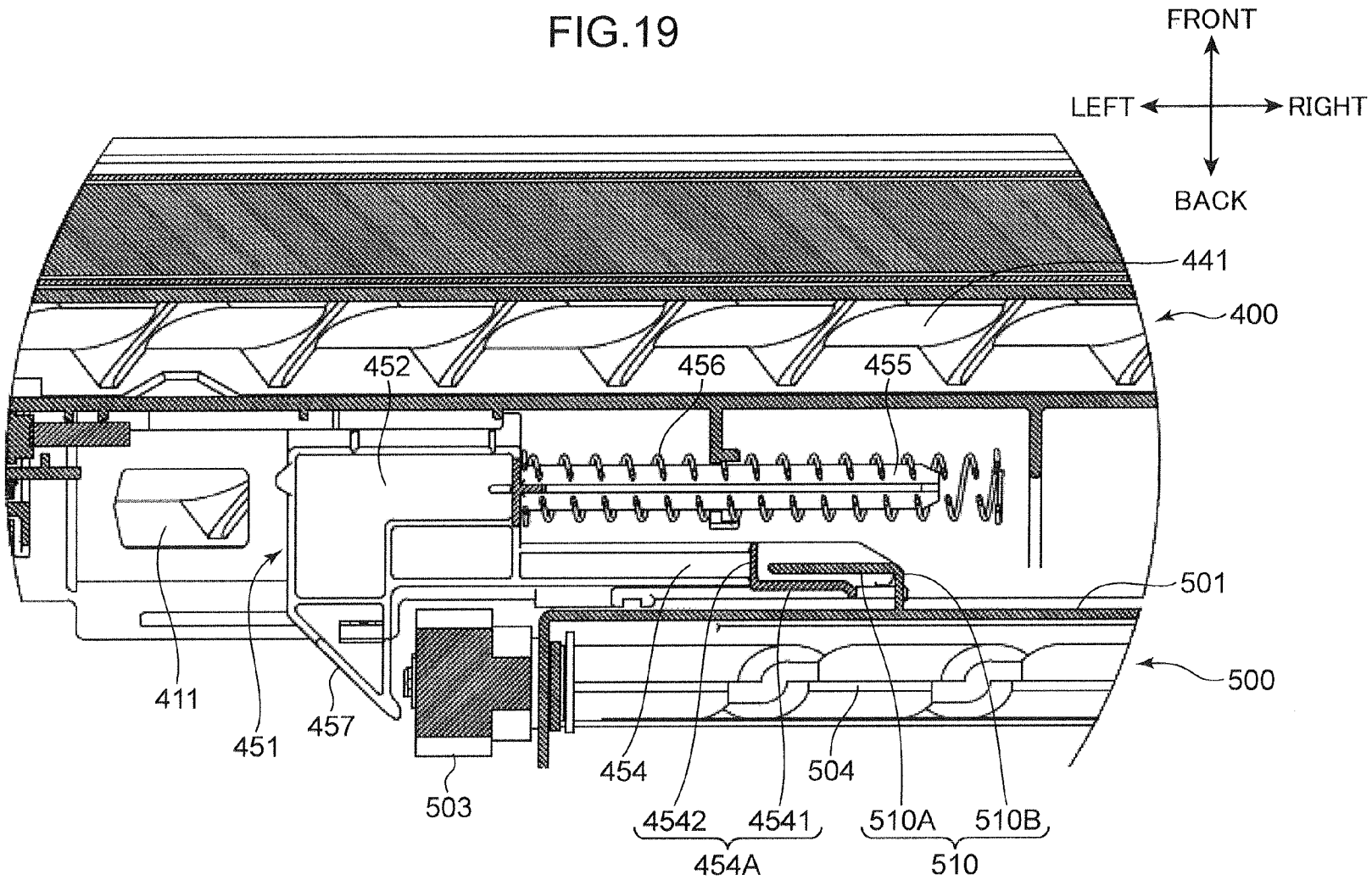
FIG. 19 is a cross-sectional diagram taken along line XIX-XIX of FIG. 17, showing a state in which a first locking piece and second locking piece are engaged with each other.
Figure 20:
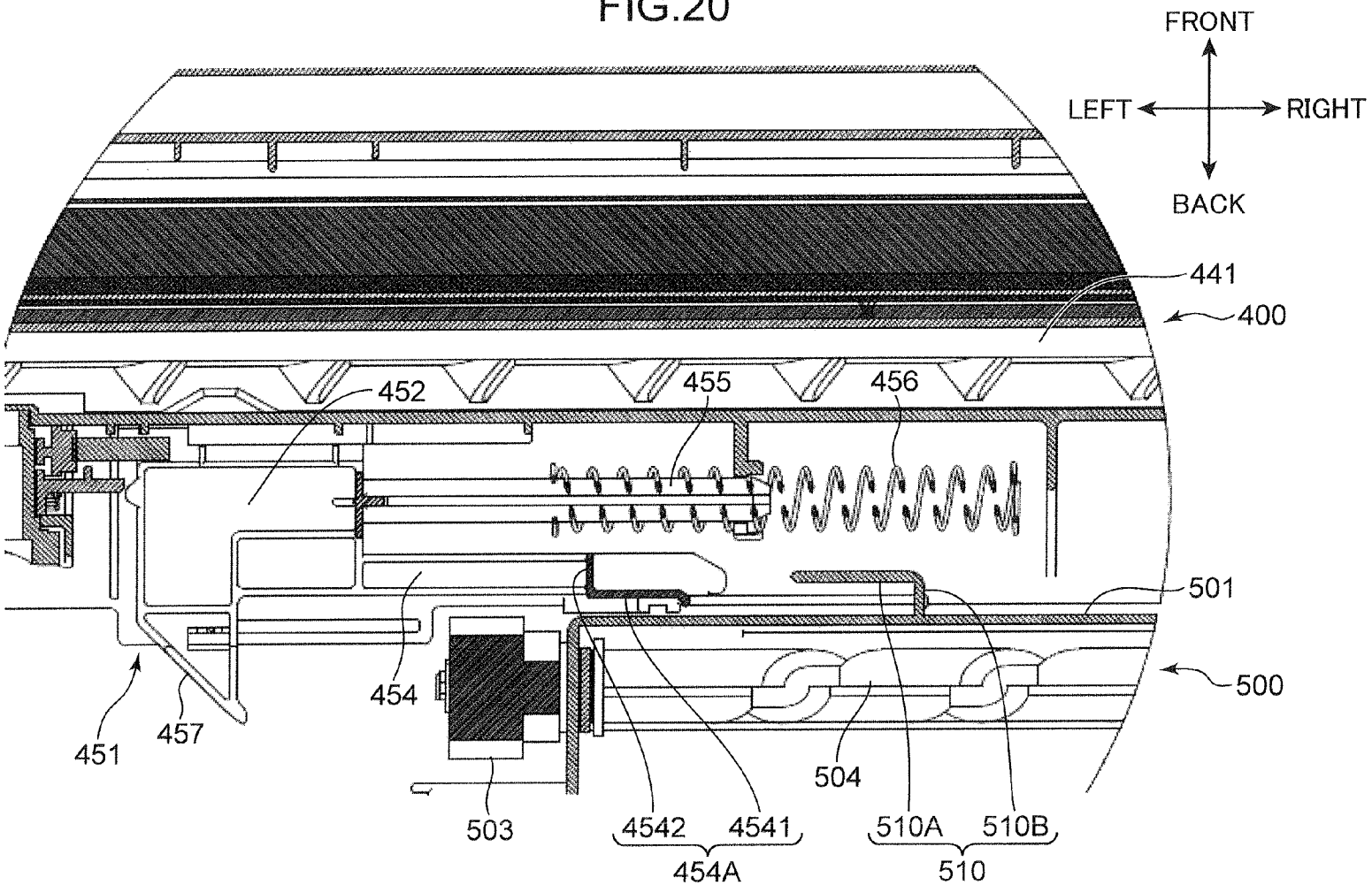
FIG. 20 is a cross-sectional diagram taken along line XIX-XIX of FIG. 17, showing a state in which the engagement between the first locking piece and the second locking piece are released.

This fact is described hereinafter in detail with reference to FIGS. 19 and 20. FIG. 19 is a cross-sectional diagram taken along line XIX-XIX of FIG. 17, showing a state in which the first locking piece 454A and the second locking piece 510 are engaged with each other. FIG. 20 shows a state in which the engagement therebetween is released. In FIG. 19 the shutter member 451 of the developing device 400 is in the opening posture. In other words, the toner container 300 is mounted to the main body housing 200. Here, the first interference wall 4541 of the first locking piece 454A provided in the shutter member 451 is fitted in a space between the second interference wall 510A of the second locking piece 510 provided in the toner collection container 500 and the front wall of the container main body 501.

Thus, when the user attempts to pull the developing device 400 forward through the front wall 220, the first interference wall 4541 and the second interference wall 510A overlap with each other in the front-back direction and therefore interfere with each other. Therefore, the developing device 400 cannot be removed from the main body housing 200.

In FIG. 20, on the other hand, the shutter member 451 of the developing device 400 moves to the left and enters the closing posture. In other words, the toner container 300 is removed from the main body housing 200. As the shutter member 451 moves to the left, the first locking piece 454A separates from the second locking piece 510. In other words, the first interference wall 4541 of the first locking piece 454A and the second interference wall 510A of the second locking piece 510 do not overlap with each other in the front-back direction. The user, therefore, can pull the developing device 400 forward through the front wall 220 and remove the developing device 400 from the main body housing 200.

According to the image forming apparatus 100 of the present embodiment, the interference mechanism composed of the engagement structure between the first locking piece 454A and the second locking piece 510 prevents the developing device 400 from being removed from the main body housing 200 when the toner container 300 is mounted to the main body housing 200, as described above. Therefore, the developing device 400 can be removed naturally according to the standard procedure, preventing the toner from scattering.

The engagement (interference) between the first locking piece 454A of the developing device 400 and the second locking piece 510 of the toner collection container 500 also can disable the developing device 400 from being removed from the main body housing 200. Engagement between the first locking piece 454A and the second locking piece 510 and release of the engagement depend on the operations of mounting and removing the toner container 300 to and from the main body housing 200. Therefore, removal of the developing device 400 from the main body housing 200 is disabled at the same time when the toner container 300 is mounted to the main body housing 200, and removal of the developing device 400 from the main body housing 200 is enabled at the same time when the toner container 300 is removed from the main body housing 200.

Furthermore, opening of the toner replenishing port 411 and engagement between the first locking piece 454A and the second locking piece 510 can be realized as a result of interference between the shutter member 451 of the developing device 400 and the pressing part 314 that takes place when mounting the toner container 300 to the main body housing 200. On the other hand, when removing the toner container 300 from the main body housing 200, engagement between the first locking piece 454A and the second locking piece 510 is released by the biasing force of the coil spring 456 (biasing member). Thus, the interference mechanism for preventing the developing device 400 from being removed can be constructed by using the shutter member 451 for opening/closing the toner replenishing port 411, which is originally provided in the developing device 400.

In addition, the image forming apparatus 100 is configured such that the toner collection container 500 cannot be removed from the main body housing 200 as long as the toner container 300 is not removed from the main body housing 200. The toner collection container 500 is disposed behind the developing device 400 so as to be adjacent thereto on substantially the same level as the developing device 400. By constructing the interference mechanism using this toner collection container 500, the interference mechanism can be caused to function reliably with a simple structure of bringing the locking pieces in to engagement with each other.

The above has described the image forming apparatus 100 according to an embodiment of the present disclosure; however, the present disclosure is not limited thereto, and, for example, the following embodiments can be made.

(1) The embodiment above has described the example in which the shutter member 451 is provided with the first locking piece 454A and the toner collection container 500 is provided with the second locking piece 510 to configure the interference mechanism. This configuration is merely an example, and there is no limit on the interference mechanism. For example, the second locking piece 510 may be provided in the internal frame 280 of the main body housing 200 or other units. The first locking piece 454A may not be provided in the shutter member 451 but in the developing housing 410. However, it is preferred that the first locking piece 454A be provided in a member, such as the shutter member 451, that operates simultaneously with the operations of mounting and removing the toner container 300 to and from the main body housing 200.

(2) The embodiment above has described the interference mechanism in which two wall members face each other, i.e., the first interference wall 4541 of the first locking piece 454A and the second interference wall 510A of the second locking piece 510. This is merely an example. For instance, the first locking piece may be a projection, and the second locking piece may be a concave part capable of storing the projection therein. Alternatively, an electrical drive member such as a solenoid actuator may be used to bring the first locking piece and the second locking piece into engagement with each other and to release this engagement.

(3) The embodiment above has described the example in which the developing device 400 and the toner container 300 are attached to and detached from the different surfaces on the main body housing 200. However, the developing device 400 and the toner container 300 may be attached to and detached from the same surface on the main body housing 200.

According to the present disclosure, the interference mechanism can prevent the developing device from being removed from the main body housing when the developer container is mounted to the main body housing, as described above. Therefore, the present disclosure can prevent the contamination of the main body housing or the area surrounding the image forming apparatus that is caused by the developer scattering from the replenishing port of the developer container.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a main body housing;

an image carrier that is stored in the main body housing and has a circumferential surface on which an electrostatic latent image is formed;

a developing device that is stored detachably in the main body housing and supplies a developer to the electrostatic latent image to develop the electrostatic latent image;

a developer container that is stored detachably in the main body housing and supplies the developer to the developing device; and an interference mechanism that disables the developing device from being removed from the main body housing, in a state where the developer container is mounted to the main body housing.

2. The image forming apparatus according to claim 1, wherein the main body housing has a first surface and a second surface located in a different section from the first surface, the developing device is attached to and detached from the main body housing through the first surface, and the developer container is attached to and detached from the main body housing through the second surface.

3. The image forming apparatus according to claim 1, further comprising:

another unit stored in the main body housing, wherein the interference mechanism is configured by a first locking piece provided in the developing device and a second locking piece provided in the other unit, the first locking piece and the second locking piece are brought into engagement with each other when the developer container is mounted to the main body housing, and the engagement between the first locking piece and the second locking piece is released when the developer container is removed from the main body housing.

4. The image forming apparatus according to claim 3, wherein the developing device has a developing housing provided with a developer replenishing port, a shutter member capable of changing a posture thereof between a closing posture for covering the replenishing port and an opening posture for opening the replenishing port, and a biasing member for biasing the shutter member in a direction of the closing posture, the developer container has a pressing part that interferes with the shutter member when the developer container is mounted to the main body housing and that changes the posture of the shutter member to the opening posture against the bias of the biasing member, the first locking piece is provided in the shutter member, the first locking piece and the second locking piece are brought into engagement with each other by changing the posture of the shutter member to the opening posture as a result of the interference between the pressing part and the shutter member that takes place when the developer container is mounted to the main body housing, and the engagement between the first locking piece and the second locking piece is released as the bias of the biasing member changes the posture of the shutter member to the closing posture when the interference between the pressing part and the shutter member is released as a result of removing the developer container from the main body housing.

5. The image forming apparatus according to claim 4, wherein the developing device has a developing roller for carrying the developer, the developing housing is a housing elongating in an axial direction of the developing roller, and the developer container is installed in the developing device from a direction perpendicular to the axial direction within a horizontal plane.

6. The image forming apparatus according to claim 3, wherein the other unit is a collection container that is stored detachably in the main body housing and collects a waste developer, and the collection container is mounted to the main body housing such that the collection container cannot be removed from the main body housing when the developer container is mounted to the main body housing.

* * * * *